US010280591B2

(12) United States Patent
Takigawa et al.

(10) Patent No.: US 10,280,591 B2
(45) Date of Patent: May 7, 2019

(54) WORK MACHINE

(71) Applicant: Hitachi Construction Machinery Co., Ltd., Taito-ku, Tokyo (JP)

(72) Inventors: Yoshiyuki Takigawa, Kasumigaura (JP); Yasunori Ota, Tsuchiura (JP); Shiho Izumi, Hitachinaka (JP); Yuichiro Morita, Hitachi (JP); Kouichi Shibata, Kasumigaura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 103 days.

(21) Appl. No.: 15/516,497

(22) PCT Filed: Oct. 2, 2015

(86) PCT No.: PCT/JP2015/078122
§ 371 (c)(1),
(2) Date: Apr. 3, 2017

(87) PCT Pub. No.: WO2016/056490
PCT Pub. Date: Apr. 14, 2016

(65) Prior Publication Data

US 2018/0238024 A1 Aug. 23, 2018

(30) Foreign Application Priority Data

Oct. 6, 2014 (JP) ..... 2014-205936

(51) Int. Cl.
*E02F 9/20* (2006.01)
*F02D 29/02* (2006.01)
(Continued)

(52) U.S. Cl.
CPC ..... *E02F 9/2066* (2013.01); *E02F 9/20* (2013.01); *E02F 9/226* (2013.01); *F02D 29/00* (2013.01);
(Continued)

(58) Field of Classification Search
CPC ..... E02F 9/2066; E02F 9/226; F02D 29/04; F02D 29/02
See application file for complete search history.

(56) References Cited

U.S. PATENT DOCUMENTS 3,758,835 A * 9/1973 Rose ..... G05B 19/07 318/162
5,270,689 A 12/1993 Hermann
(Continued)

FOREIGN PATENT DOCUMENTS

DE 11 2008 000 812 T5 2/2010
EP 0 366 132 A2 5/1990
(Continued)

OTHER PUBLICATIONS

International Preliminary Report on Patentability (PCT/IB/338 & PCT/IB/373) issued in PCT Application No. PCT/JP2015/078122 dated Apr. 20, 2017, including English translation of document C2 (Japanese-language Written Opinion (PCT/SA/237)) previously filed on Apr. 3, 2017 (7 pages).
(Continued)

*Primary Examiner* — Yonel Beaulieu
*Assistant Examiner* — Martin A Weeks
(74) *Attorney, Agent, or Firm* — Crowell & Moring LLP

(57) ABSTRACT

A work machine that can prevent restarting of an engine against a will of an operator from an idle stop state is provided. A hydraulic excavator includes a display device that displays a confirmation screen image for allowing an operator to confirm whether or not an engine is to be restarted from an idle stop state, and an inputting device that allows the operator to input a restart instruction for the engine in an interlocked relationship with the display of the confirmation screen image. A machine controller includes a restart controlling section that restarts the engine based on
(Continued)

the restart instruction for the engine inputted by the inputting device.

6 Claims, 9 Drawing Sheets

(51) Int. Cl.

| | |
|---|---|
| ***F02D 29/04*** | (2006.01) |
| ***F02D 29/06*** | (2006.01) |
| ***F02D 29/00*** | (2006.01) |
| ***E02F 9/22*** | (2006.01) |

(52) U.S. Cl.
CPC ..... *F02D 29/02* (2013.01); *F02D 29/04* (2013.01); *F02D 29/06* (2013.01)

(56) References Cited

U.S. PATENT DOCUMENTS

| | | | | |
|---|---|---|---|---|
| 2002/0134227 | A1* | 9/2002 | Nakatani | E02F 9/22 91/446 |
| 2006/0179830 | A1* | 8/2006 | Kamon | E02F 9/2246 60/431 |
| 2010/0064677 | A1 | 3/2010 | Kawaguchi et al. | |
| 2015/0247513 | A1* | 9/2015 | Morris | E02F 9/2066 701/50 |

FOREIGN PATENT DOCUMENTS

| | | | |
|---|---|---|---|
| EP | 1 628 008 | A1 | 2/2006 |
| GB | 2 424 964 | A | 10/2006 |
| JP | 2003-65097 | A | 3/2003 |
| JP | 4010255 | B2 | 11/2007 |
| JP | 2008-57469 | A | 3/2008 |
| JP | 2008-255839 | A | 10/2008 |
| JP | 2013-64320 | A | 4/2013 |
| WO | WO 2005/054649 | A1 | 6/2005 |

OTHER PUBLICATIONS

Extended European Search Report issued in counterpart European Application No. 15848729.8 dated Apr. 20, 2018 (eight pages).
International Search Report (PCT/ISA/210) issued in PCT Application No. PCT/JP2015/078122 dated Dec. 28, 2015 with English translation (Four (4) pages).
Japanese-language Written Opinion (PCT/ISA/237) issued in PCT Application No. PCT/JP2015/078122 dated Dec. 28, 2015 (Four (4) pages).

* cited by examiner

WORK MACHINE

TECHNICAL FIELD

The present invention relates to a work machine that performs engine restarting from an idle stop state.

BACKGROUND ART

In a work machine represented by a hydraulic excavator, an idle stop technology for automatically stopping an engine during non-work in order to reduce the fuel consumption, the amount of carbon oxide and noise is known.

In the idle stop technology, an invention is known in which, in order to avoid cumbersomeness in operation by an operator, a sensor is provided at means other than means for turning an engine key, for example, at an operation lever or in the proximity of the operation lever such that the engine is restarted from the idle stop state in response to a detection value of the sensor (for example, refer to Patent Document 1).

PRIOR ART DOCUMENTS

Patent Documents

Patent Document 1: Japanese Patent No. 4010255

SUMMARY OF THE INVENTION

Problem to be Solved by the Invention

However, the technology disclosed in Patent Document 1 mentioned above has such a problem as described below.

For example, in Patent Document 1, from an operation of the operation lever or through the sensor attached in the proximity of the operation lever, it is decided that the operator has a will for engine restarting, and engine restarting is performed from the idle stop state. However, the operation lever or a location in the proximity of the operation lever is a part with which, when the operator moves, the operator may touch with a high degree of possibility. Therefore, if it is adopted as a condition for engine restarting to approach the operation lever on which the sensor is disposed as in the technology of Patent Document 1, then if the operator accidentally touches with the operation lever, then there is the possibility that the engine may be restarted against a will of the operator, and there is the possibility that a hydraulic actuator may be driven against a will of the operator.

The present invention provides a work machine that can prevent restarting of an engine against a will of an operator from an idle stop state.

Means for Solving the Problem

In order to attain the object described above, according to the present invention, there is provided a work machine that includes an engine, a hydraulic pump driven by the engine, a plurality of hydraulic actuators driven by hydraulic fluid from the hydraulic pump, a lock device configured to control the plurality of hydraulic actuators inoperative, and a control device including an idle stop controlling section configured to stop the engine in response to an operation position of the lock device, the work machine including a display device configured to display a confirmation screen image for allowing an operator to confirm whether or not the engine is to be restarted from an idle stop state in which the engine is stopped by the idle stop controlling section, and an inputting device configured to allow the operator to input a restart instruction for the engine in an interlocked relationship with the display of the confirmation screen image, the control device including a restart controlling section configured to restart the engine based on the restart instruction for the engine inputted through the inputting device.

Effect of the Invention

According to the present invention, it is possible to prevent restarting of an engine against a will of an operator from an idle stop state.

MODES FOR CARRYING OUT THE INVENTION

<First Embodiment>

A first embodiment of the present invention is described with reference to the drawings. It is to be noted that the present embodiment is directed to a case in which the present invention is applied to a hydraulic excavator as a work machine.

Figure 1:
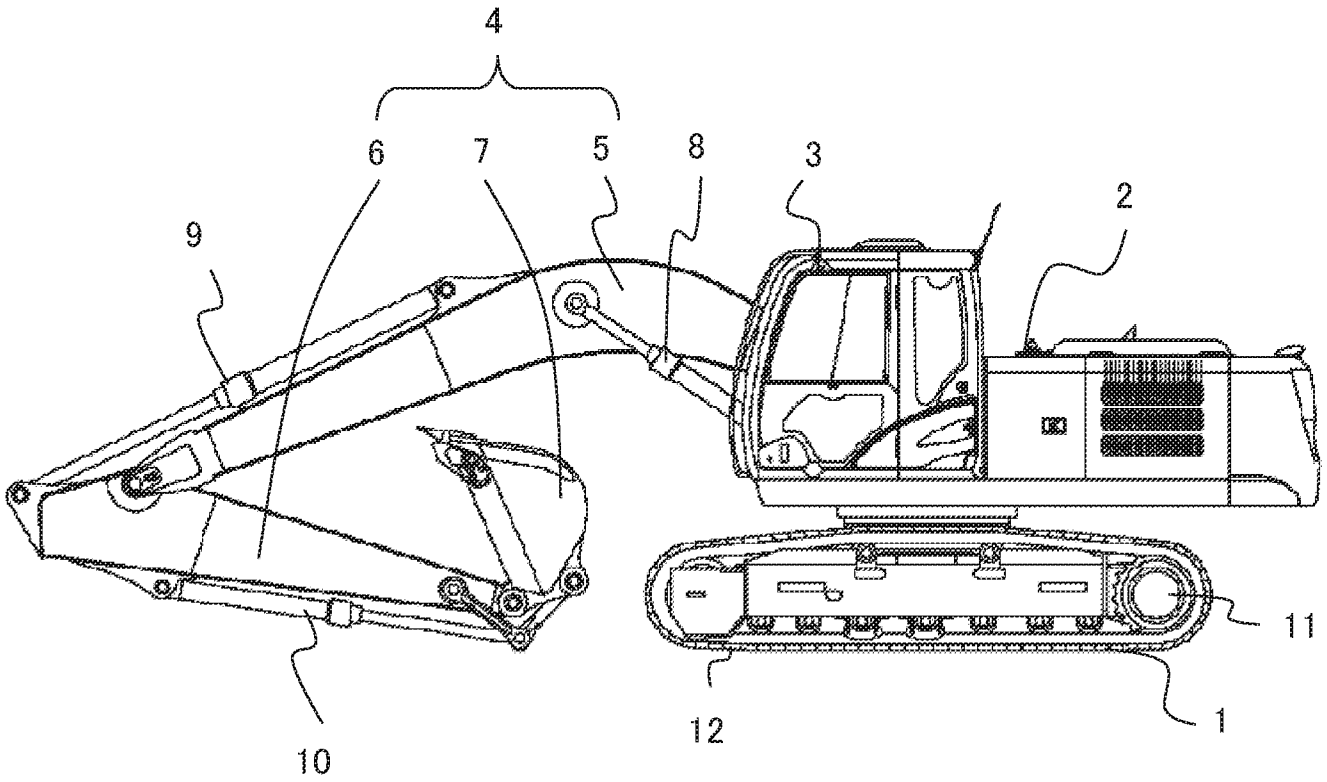
FIG. 1 is a side elevational view depicting an appearance of a hydraulic excavator according to a first embodiment of the present invention.
Figure 2:
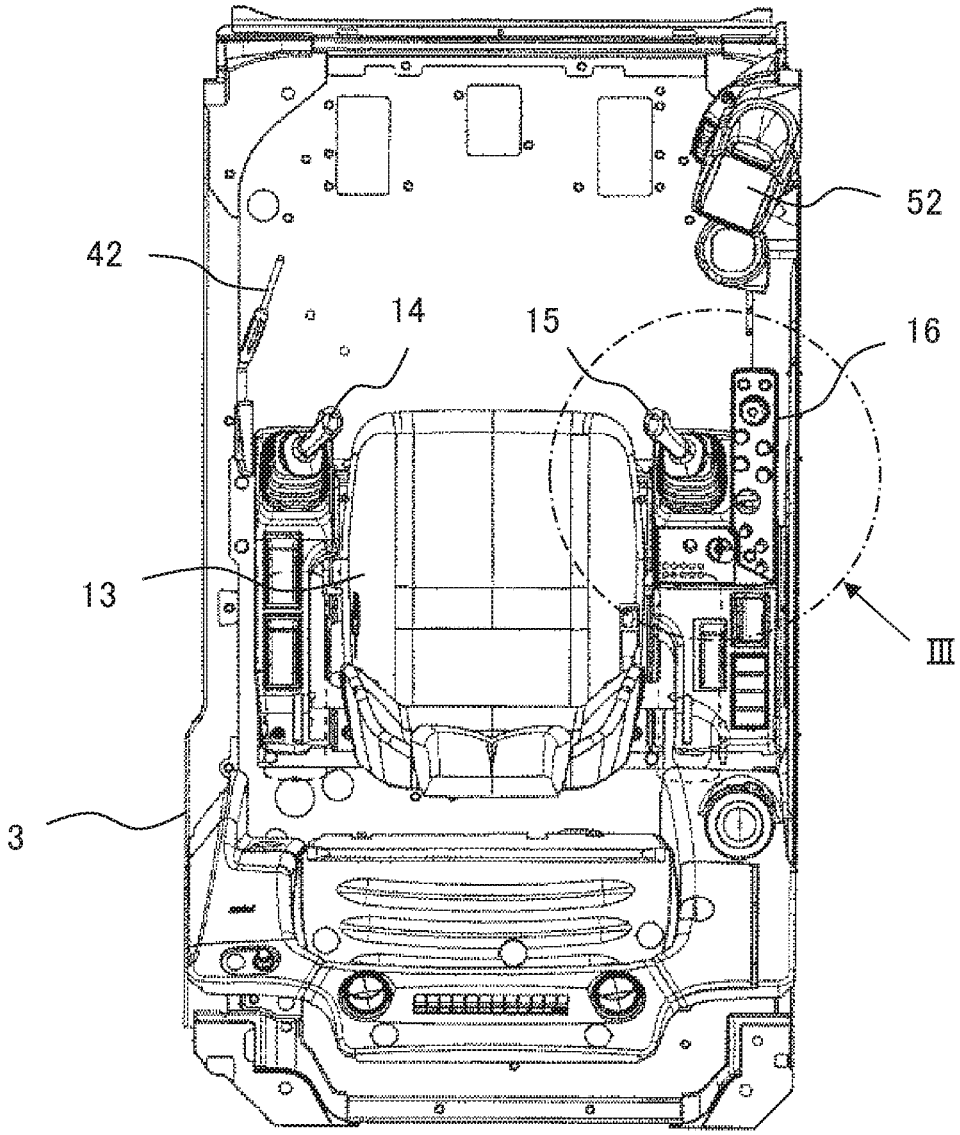
FIG. 2 is a plan view depicting an internal structure of a cabin of the hydraulic excavator according to the first embodiment of the present invention.
Figure 3:
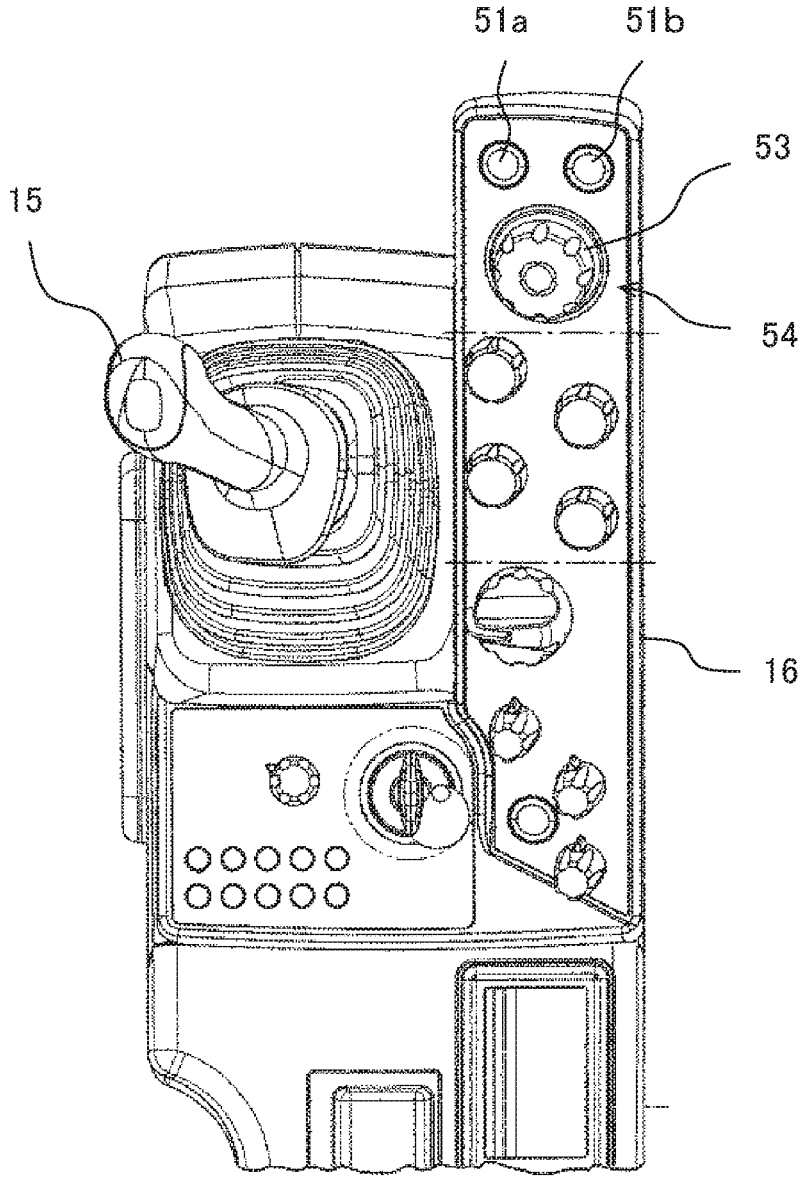
FIG. 3 is a partial enlarged view of a portion III in FIG. 2.

FIG. 1 is a side elevational view representing an appearance of the hydraulic excavator according to the present embodiment. FIG. 2 is a plan view depicting an internal structure of a cabin of the hydraulic excavator according to the present embodiment, and FIG. 3 is a partial enlarged view of a portion III in FIG. 2.

As depicting in FIG. 1, the hydraulic excavator includes a track structure 1, a swing structure 2 and a front work implement 4.

The track structure 1 has left and right track devices 12 of the crawler type, which are driven by left and right track motors 11. The swing structure 2 is swingably mounted on the track structure 1 and is driven to swing by a swing motor (not depicted). The swing structure 2 has an engine room and a cabin 3 provided thereon.

The front work implement 4 is elevatably attached at a front portion of the swing structure 2. The front work implement 4 is composed of a boom 5 pivotably provided on the swing structure 2, an arm 6 pivotably provided at an end portion of the boom 5, a bucket 7 pivotably provided at an end portion of the arm 6 and so forth. The boom 5 is pivoted in upward and downward directions through elongation and contraction of a boom cylinder 8, and the arm 6 is pivoted in upward and downward directions and forward and rearward directions through elongation and contraction of an arm cylinder 9. The bucket 7 is pivoted in upward and downward directions and forward and rearward directions through elongation and contraction of a bucket cylinder 10.

As depicted in FIG. 2, an operator's seat 13 for being seated by an operator is provided in the cabin 3. A front side operation device (not depicted) for operating the track devices 12 is provided in front of the operator's seat 13. A left side operation device 14 for operating the swing structure 2 and the arm 6 is provided on the left side of the operator's seat 13. A right side operation device 15 for operating the boom 5 and the bucket 7 is provided on the right side of the operator's seat 13.

A display device 52 is provided forwardly on the right side of the operator's seat 13. As depicted in FIGS. 2 and 3, a switch box 16 is provided on the outer side of the operation device 15, and an inputting device 54 is provided at a front portion of the switch box 16. It is to be noted that, since the inputting device 54 is provided on the switch box 16 positioned on the outer side of the operation device 15, the operator can operate the inputting device 54 without touching the operation device 15.

The display device 52 displays a variety of information about the hydraulic excavator and a screen image for confirmation or change of a setting of the hydraulic excavator. The inputting device 54 interlocks with screen image displayed on the display device 52. In particular, the inputting device 54 is configured such that a first operation for selecting one of a plurality of icons on a screen image displayed on the display device 52 and a second operation, different in operation mode from the first operation, for determining the selected icon to input a setting or an instruction can be performed. The inputting device 54 in the present embodiment includes a rotary switch 53 capable of performing a rotational operation as the first operation and a push operation as the second operation. Further, the inputting device 54 has switches 51*a* and 51*b* for screen image changeover.

A gate lock lever 42 is provided at the entrance of the cabin 3. The gate lock lever 42 is operated between a lock position (lifted position) and an unlock position (lowered position). Further, a lock switch (not depicted) for detecting an operation position of the gate lock lever 42 is provided. The lock switch outputs a signal corresponding to the operation position of the gate lock lever 42.

Figure 4:
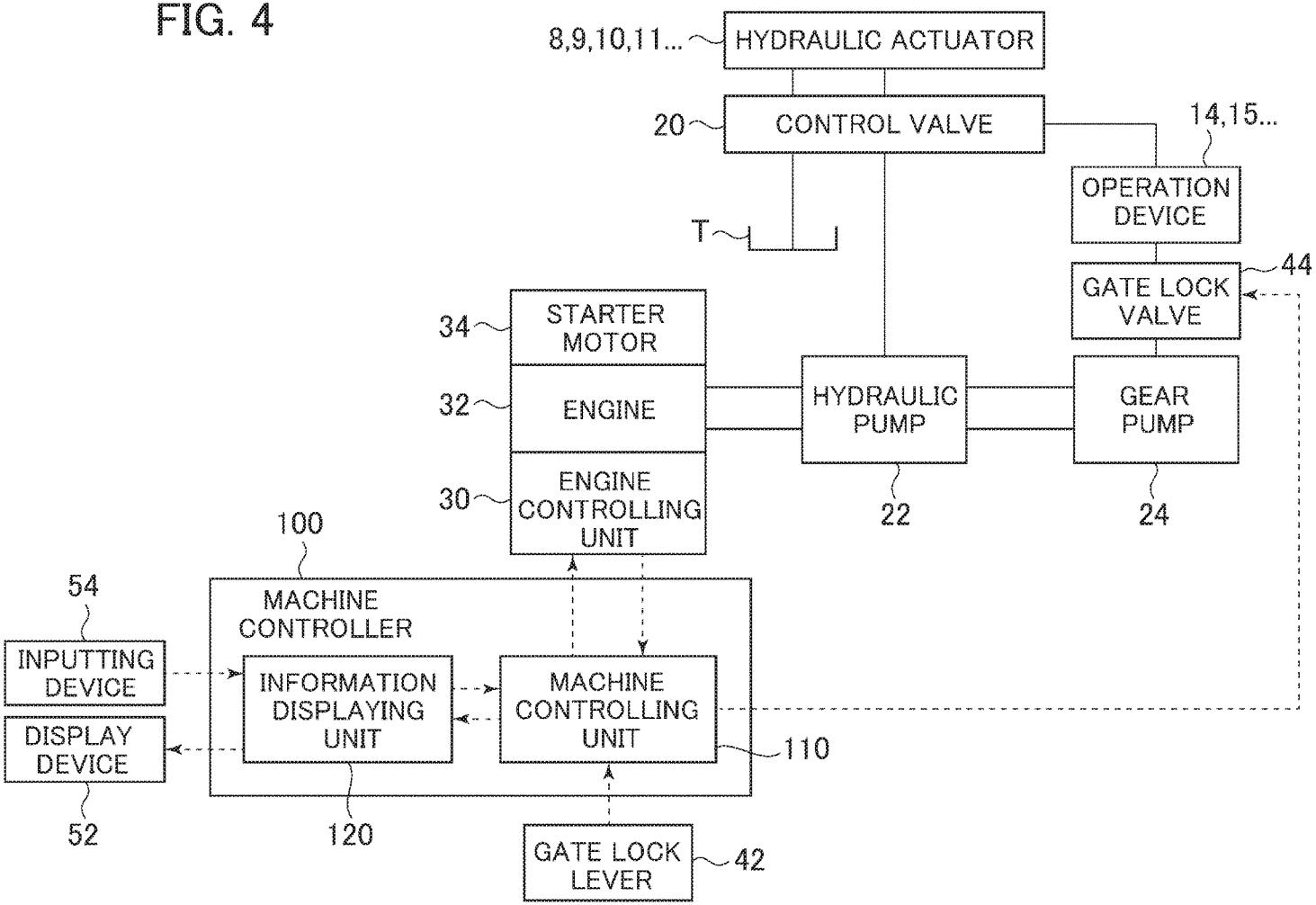
FIG. 4 is a view depicting an example of a system configuration of the hydraulic excavator according to the first embodiment of the present invention.
Figure 5:
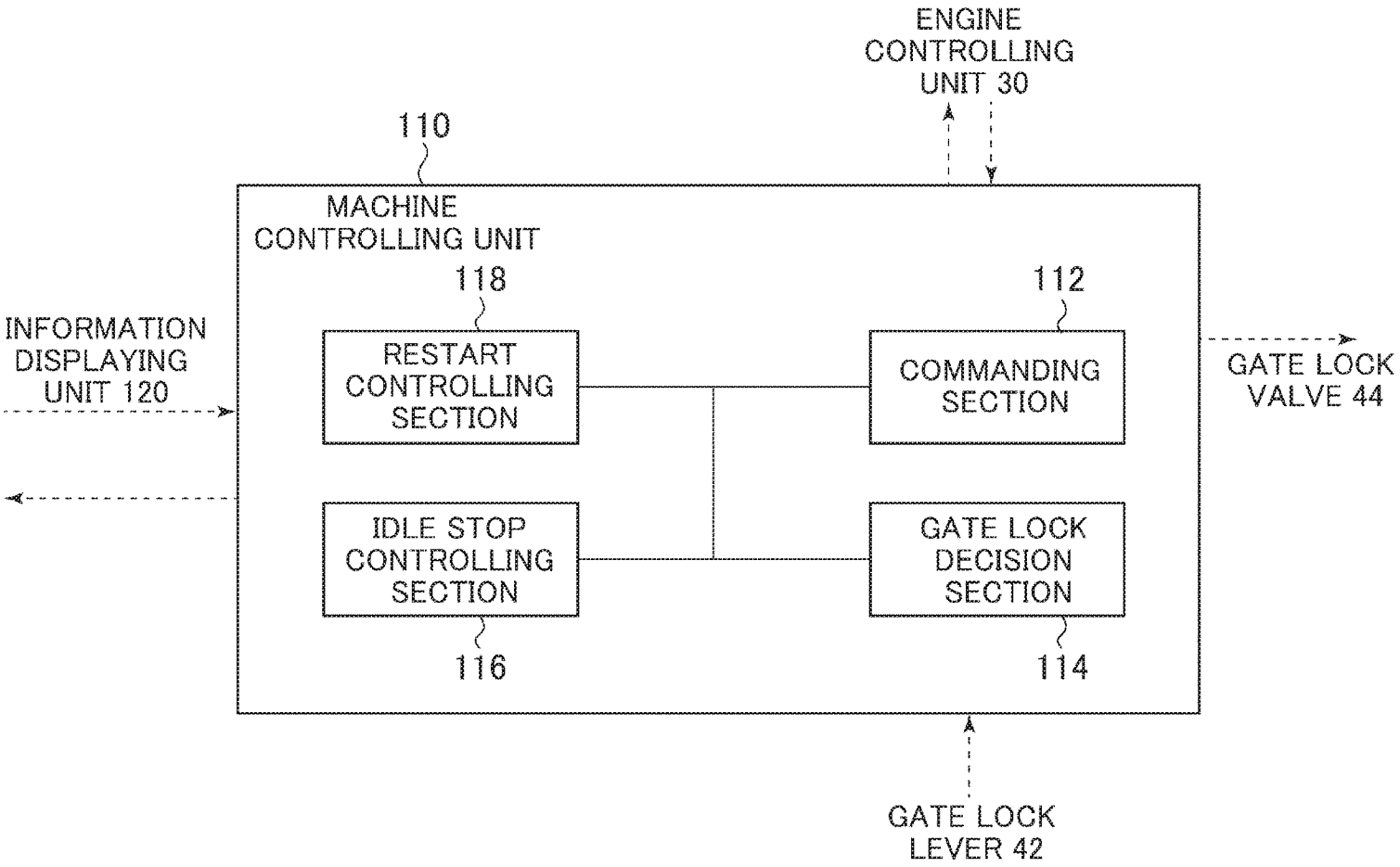
FIG. 5 is a view depicting an example of a functional configuration of a machine controlling unit of a machine controller according to the first embodiment of the present invention.

Now, a system configuration of the hydraulic excavator is described with reference to FIGS. 4 and 5. FIG. 4 is a view depicting an example of a system configuration of the hydraulic excavator according to the present invention. FIG. 5 is a view depicting an example of a functional configuration of a machine controlling unit of a machine controller according to the present embodiment.

As depicted in FIG. 4, the hydraulic excavator includes, as driving circuits, an engine 32, an engine controlling unit 30, a starter motor 34, a hydraulic pump 22, a gear pump 24, a plurality of operation devices (particularly, the left side operation device 14, right side operation device 15 and front side operation device described hereinabove and so forth, and in FIG. 4, only one is depicted as a representative), a gate lock valve 44, a plurality of control valves 20 (in FIG. 4, only one is depicted as a representative), a tank T, and a plurality of actuators (particularly, the boom cylinder 8, arm cylinder 9, bucket cylinder 10, track motors 11 and swing motor described hereinabove and so forth; in FIG. 4, only one is depicted as a representative). Further, the hydraulic excavator includes a machine controller 100 as a control device. It is to be noted that the engine 32, hydraulic pump 22, gear pump 24 and so forth are disposed in the engine room of the swing structure 2 described hereinabove, and the machine controller 100 is disposed in the cabin 3.

The engine 32 is started by the starter motor 34, and the hydraulic pump 22 and the gear pump 24 are driven by rotational motion of the engine 32.

Fluid delivered from the gear pump 24 is supplied to the operation devices 14 and 15 and so forth through the gate lock valve 44. Each of the operation devices includes an operation lever and a plurality of pilot valves (pressure reducing valves) individually corresponding to operation directions of the operation lever. Each pilot valve generates a pilot pressure in response to an operation amount in the corresponding operation direction of the operation lever, from a source pressure provided by the delivery pressure from the gear pump 24, and outputs the pilot pressure to the corresponding operation portion (pressure receiving portion) of the control valve 20. Herewith, a selection control is performed on the control valve 20.

The fluid delivered from the hydraulic pump 22 is supplied to the hydraulic actuators 8, 9, 10 and 11 and so forth through the control valve 20 on which selection control is performed in such a manner as described hereinabove. Herewith, the boom 5, arm 6, bucket 7, crawler type track devices 12 and so forth are driven.

The machine controller 100 includes a machine controlling unit 110 and an information displaying unit 120.

The information displaying unit 120 (display controlling unit) causes the display device 52 to display a variety of information about the hydraulic excavator and screen images for confirming or changing of settings of the hydraulic excavator and performs control for interlocking the display device 52 and the inputting device 54 with each other. Further, the information displaying unit 120 outputs a setting or an instruction inputted through the inputting device 54 to the machine controlling unit 110.

As depicted in FIG. 5, the machine controlling unit 110 includes a commanding section 112, a gate lock decision section 114, an idle stop controlling section 116 and a restart controlling section 118.

The gate lock decision section 114 decides on the basis of a signal from the lock switch of the gate lock lever 42 whether or not the gate lock lever 42 is positioned at the lock position. The gate lock decision section 114 outputs a signal corresponding to a result of the decision to the commanding section 112 and the idle stop controlling section 116.

If a signal indicating that the gate lock lever 42 is at the unlock position is inputted to the commanding section 112, then the commanding section 112 outputs an opening signal to the gate lock valve 44 (solenoid valve). Consequently, the gate lock valve 44 is opened, and fluid delivered from the gear pump 24 is supplied to the operation devices 14 and 15 and so forth. Accordingly, the operation devices 14 and 15 and so forth are enabled to generate a pilot pressure to enable operation of the control valve 20 and enable operation of the hydraulic actuators 8, 9, 10 and 11 and so forth.

On the other hand, if a signal indicating that the gate lock lever 42 is positioned at the lock position is inputted to the commanding section 112, then the commanding section 112 outputs a closing signal to the gate lock valve 44. Consequently, the gate lock valve 44 is closed, and fluid delivered from the gear pump 24 is not supplied to the operation devices 14 and 15 and so forth (hydraulic pressure lock). Accordingly, the operation devices 14 and 15 and so forth are disabled from generating a pilot pressure thereby to disable operation of the control valve 20 and disable operation of the hydraulic actuators 8, 9, 10 and 11 and so forth.

It is to be noted that the gate lock lever 42 and the gate lock valve 44 described above as well as the functions of the gate lock decision section 114 and the commanding section 112 associated with the gate lock lever 42 and the gate lock valve 44 configure a lock device for controlling the hydraulic actuators 8, 9, 10 and 11 and so forth such that operation of them is disabled.

If a signal relating to an auto idle stop condition set in advance is inputted to the idle stop controlling section 116, then the idle stop controlling section 116 decides on the basis of the signal whether or not the auto idle stop condition is satisfied. The auto idle stop condition includes an ON setting for carrying out the idle stop control and the gate lock lever 42 being kept at the lock position for more than a period of time set in advance. If the idle stop controlling section 116 decides that the auto idle stop condition is satisfied, then it outputs a corresponding signal to the commanding section 112. The commanding section 112 outputs a command signal for engine stopping to the engine controlling unit 30 in response to the signal from the idle stop controlling section 116. The engine controlling unit 30 performs stopping control (idle stop) of the engine 32 in response to the command signal for engine stopping from the commanding section 112.

Figure 6:
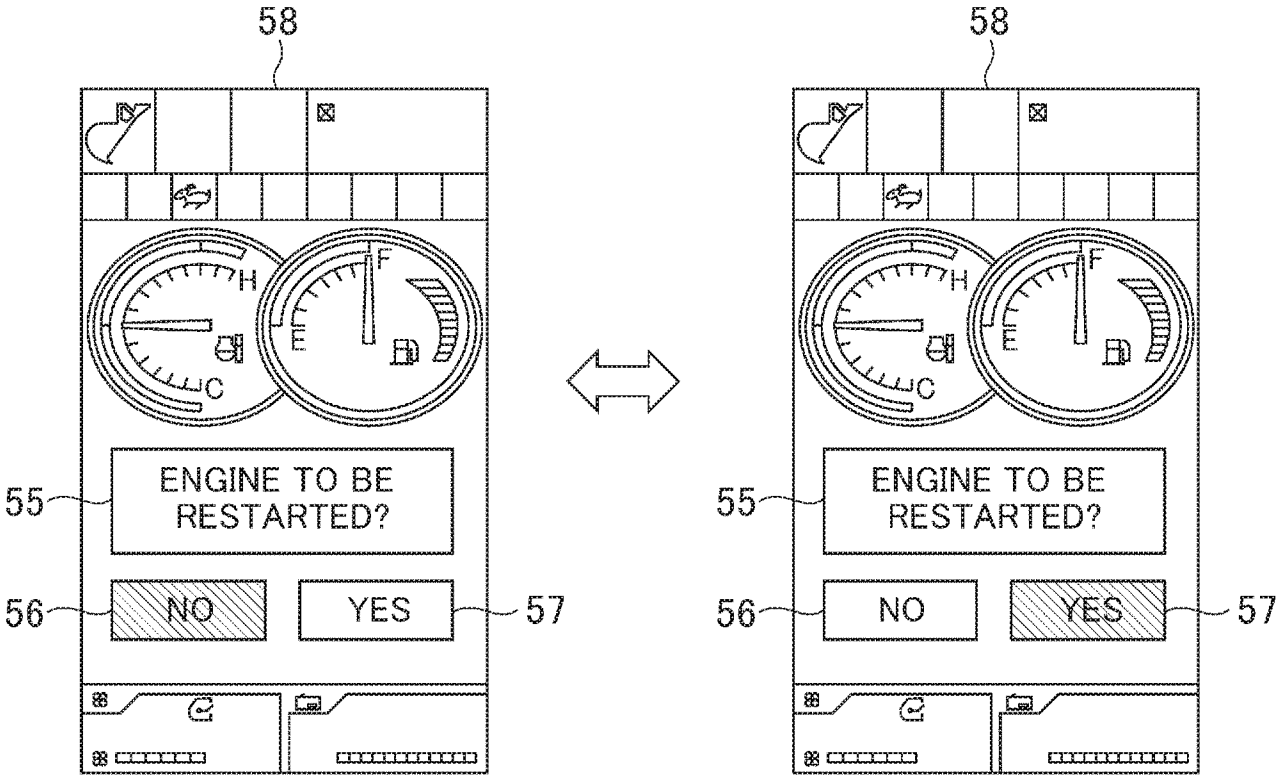
FIG. 6 is a view depicting an example of a confirmation screen image displayed on a display device according to the first embodiment of the present invention.

On the other hand, in an idle stop state of the engine 32, the idle stop controlling section 116 outputs a command signal for displaying a confirmation screen image to the information displaying unit 120. The information displaying unit 120 causes the display device 52 to display such a confirmation screen image 58 as depicted in FIG. 6 in response to the command signal for displaying a confirmation screen image. The confirmation screen image 58 is an image for allowing the operator to confirm whether or not the engine 32 is to be restarted from the idle stop state.

The confirmation screen image 58 has a message 55 for the confirmation of a will of the operator to restart the engine, a standby icon ("NO" icon) 56, and a restarting icon ("YES" icon) 57. The confirmation screen image 58 discernibly shows of which one of the standby icon 56 and the restarting icon 57 is selected, and the selection icon is changed over in response to an operation of the inputting device 54.

The information displaying unit 120 decides, when a predetermined operation (details are hereinafter described) of the inputting device 54 is performed while the confirmation screen image 58 is displayed on the display device 52, that an instruction for engine restart is inputted, and outputs the instruction to the restart controlling section 118.

The restart controlling section 118 outputs, when an instruction for engine restart is inputted thereto from the information displaying unit 120, a corresponding signal to the commanding section 112. The commanding section 112 outputs a command signal for engine restart to the engine controlling unit 30 in response to the signal from the restart controlling section 118. The engine controlling unit 30 controls driving of the starter motor 34 in response to the restart command signal to restart the engine 32.

Figure 7:
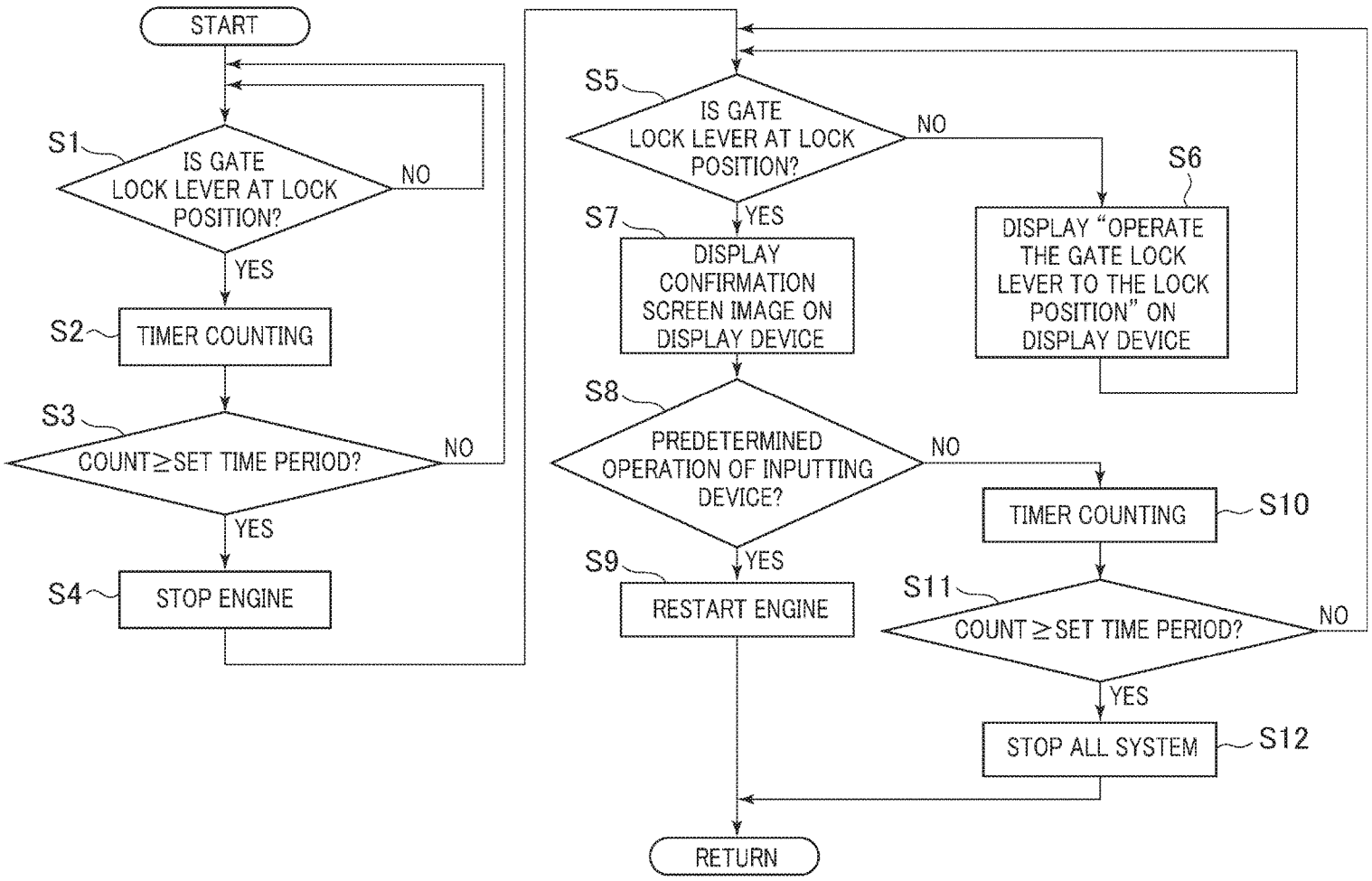
FIG. 7 is a view illustrating an example of a control flow of the machine controller according to the first embodiment of the present invention.

Now, control operation of the present embodiment is described with reference to FIG. 7. FIG. 7 is a view illustrating an example of a control flow of the machine controller 100 in the present embodiment.

First, the gate lock decision section 114 of the machine controlling unit 110 of the machine controller 100 decides whether or not the gate lock lever 42 is changed over to the lock position by the operator (step S1). If the gate lock decision section 114 decides that the gate lock lever 42 is changed over to the lock position with the engine 32 kept on by the operator for damp waiting during excavation work or the like (YES at step S1), then the gate lock decision section 114 outputs an activation signal to the idle stop controlling section 116. In response to the activation signal, idle stop control of the idle stop controlling section 116 is activated. On the other hand, if it is not decided that the gate lock lever 42 is changed over to the lock position by the operator (NO at step S1), then the gate lock decision section 114 returns its processing to step S1 to continue to decide whether or not the gate lock lever 42 is changed over to the lock position.

After the activation of the idle stop control, the idle stop controlling section 116 starts counting of an elapsed time period after the gate lock lever 42 is changed over to the lock position using a timer built therein (step S2).

Then, the idle stop controlling section 116 decides whether or not the counted time period after the gate lock lever 42 is changed over to the lock position reaches a predetermined set time period (step S3).

If it is decided that the counted time period reaches the set time period (YES at step S3), then the idle stop controlling section 116 outputs a command signal for engine stopping to the engine controlling unit 30 through the commanding section 112. The engine controlling unit 30 stops the engine 32 on the basis of the engine stopping command signal (step S4).

On the other hand, if the counted time period does not reach the predetermined set time period (NO at step S3), then the processing is returned to step S1. If the gate lock lever 42 is changed over to the unlock position during the counting, then the counted time period is reset, and the processing returns to the flow at step S1.

After the engine 32 is stopped at step S4, similarly as in a key on state, the power supply to the machine controller 100 and so forth is not turned off immediately, but the functions of the machine controller 100 necessary for monitoring control or for engine restart maintain their activated state.

Thereafter, the gate lock decision section 114 decides whether or not the position of the gate lock lever 42 remains the lock position (step S5). This is because, if the engine 32 is restarted in a state in which the gate lock lever 42 is changed over to the unlock position, namely, in a state in which the gate lock valve 44 is open, then unexpected operation of any of the hydraulic actuators 8, 9, 10 and 11 may possibly occur.

If it is decided at step S5 that the gate lock lever 42 is changed over to the unlock position (NO at step S5), then the gate lock decision section 114 outputs a signal representing that the gate lock lever 42 is changed over to the unlock position to the idle stop controlling section 116. The idle stop controlling section 116 outputs a signal to the information displaying unit 120 such that the information displaying unit 120 receiving an input of the signal causes the display device 52 to display "Operate the gate lock lever to the lock position" (step S6). Then, the display is continued until after the gate lock lever 42 is changed over to the lock position (loop of steps S5 and S6).

On the other hand, if it is decided that the gate lock lever 42 is at the lock position (YES at step S5), then the gate lock decision section 114 outputs a signal representing that the gate lock lever 42 is positioned at the lock position to the idle stop controlling section 116. The idle stop controlling section 116 outputs a command signal for displaying a confirmation screen image to the information displaying unit 120 (and the restart controlling section 118) such that the information displaying unit 120 receiving an input of the signal causes the display device 52 to display the confirmation screen image 58 (step S7).

Then, the information displaying unit 120 decides whether or not a predetermined operation of the inputting device 54 is performed while the confirmation screen image 58 is displayed on the display device 52 to decide whether or not an instruction for engine restart is inputted (step S8). More particularly, the display device 52 displays, as an initial state of the confirmation screen image 58, a state in which the standby icon 56 is selected as depicted at the left side in FIG. 6. Then, the operator rotationally operates the rotary switch 53 of the inputting device 54 to change over such that the restarting icon 57 is selected as depicted at the right side in FIG. 6. If the operator performs a pushing operation of the rotary switch 53 of the inputting device 54 in the state in which the restarting icon 57 is selected, then the restarting icon 57 is determined. Consequently, the information displaying unit 120 decides that an instruction for engine restart is inputted.

If an operation of the inputting device 54 described above is not performed and an instruction for engine restart is not inputted while the confirmation screen image 58 is displayed on the display device 52 (NO at step S8), then the processing is advanced to step S10. The restart controlling section 118 uses the built-in timer to count a display time period of the confirmation screen image 58 with reference to an inputting timing of the command signal for displaying a confirmation screen image (step S10), whereafter the processing is advanced to step S11. The restart controlling section 118 decides whether or not the counted time period reaches a predetermined set time period (step S11). If it is decided that the counted time period reaches the predetermined set time period (YES at step S11), then the restart controlling section 118 turns off the power supply to the entire system to stop the hydraulic excavator in order to avoid exhaustion of the battery (step S12). On the other hand, if it is not decided that the counted time period reaches the predetermined set time period (NO at step S11), then the display of the confirmation screen image 58 is continued unless the gate lock lever 42 is changed over to the unlock position (loop of step S5, step S7, step S8, step S10 and step S11).

On the other hand, if an operation of the inputting device 54 described hereinabove is performed and an instruction for engine restart is inputted while the confirmation screen image 58 is displayed on the display device 52 (YES at step S8), then the information displaying unit 120 outputs an instruction for engine restart to the restart controlling section 118. The restart controlling section 118 receiving an input of the instruction outputs a command signal for engine restart to the engine controlling unit 30 through the commanding section 112. The engine controlling unit 30 causes the engine 32 to restart based on the command signal for engine restart (step S9). Thereafter, the processing is returned to step S1.

In the present embodiment, when the engine 32 is in a stopping state by idle stop control, the confirmation screen image 58 is displayed on the display device 52 in the cabin 3. Then, when the operator performs a rotational operation of the rotary switch 53 to select the restarting icon 57 of the confirmation screen image 58 and then performs a pushing operation of the rotary switch 53 to determine the restarting icon 57, the engine 32 is restarted. Therefore, unintended restarting of the engine 32 can be prevented. Further, since a restarting instruction is inputted in accordance with a screen image displayed on the display device 52, restarting of the engine is easy.

<Second Embodiment>

A second embodiment of the present invention is described with reference to FIGS. 8 and 9. It is to be noted that the present embodiment is directed to a case in which the present invention is applied to a hydraulic excavator of the hybrid type as a work machine.

Figure 8:
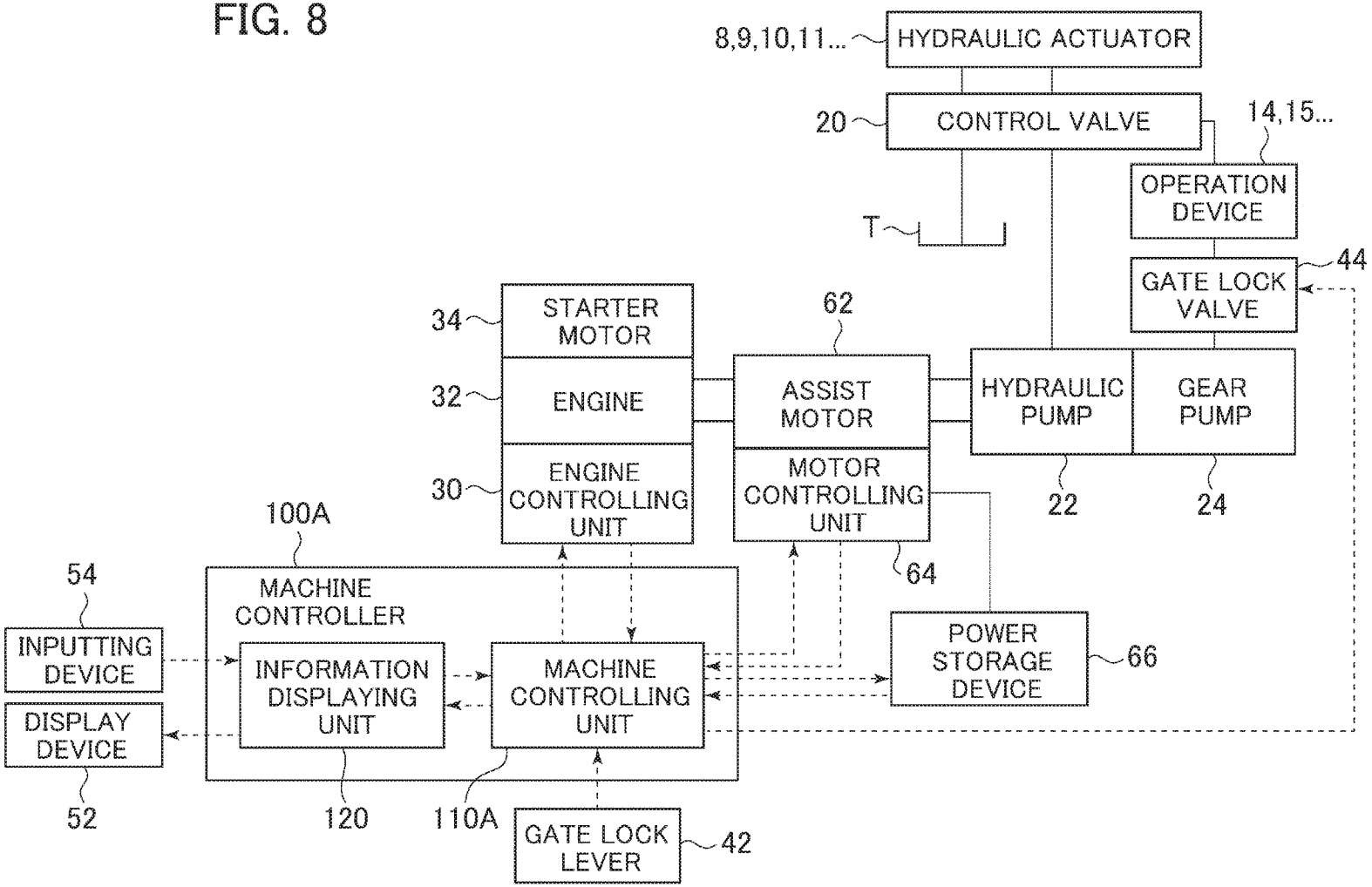
FIG. 8 is a view depicting an example of a system configuration of a hydraulic excavator of the hybrid type according to a second embodiment of the present invention.
Figure 9:
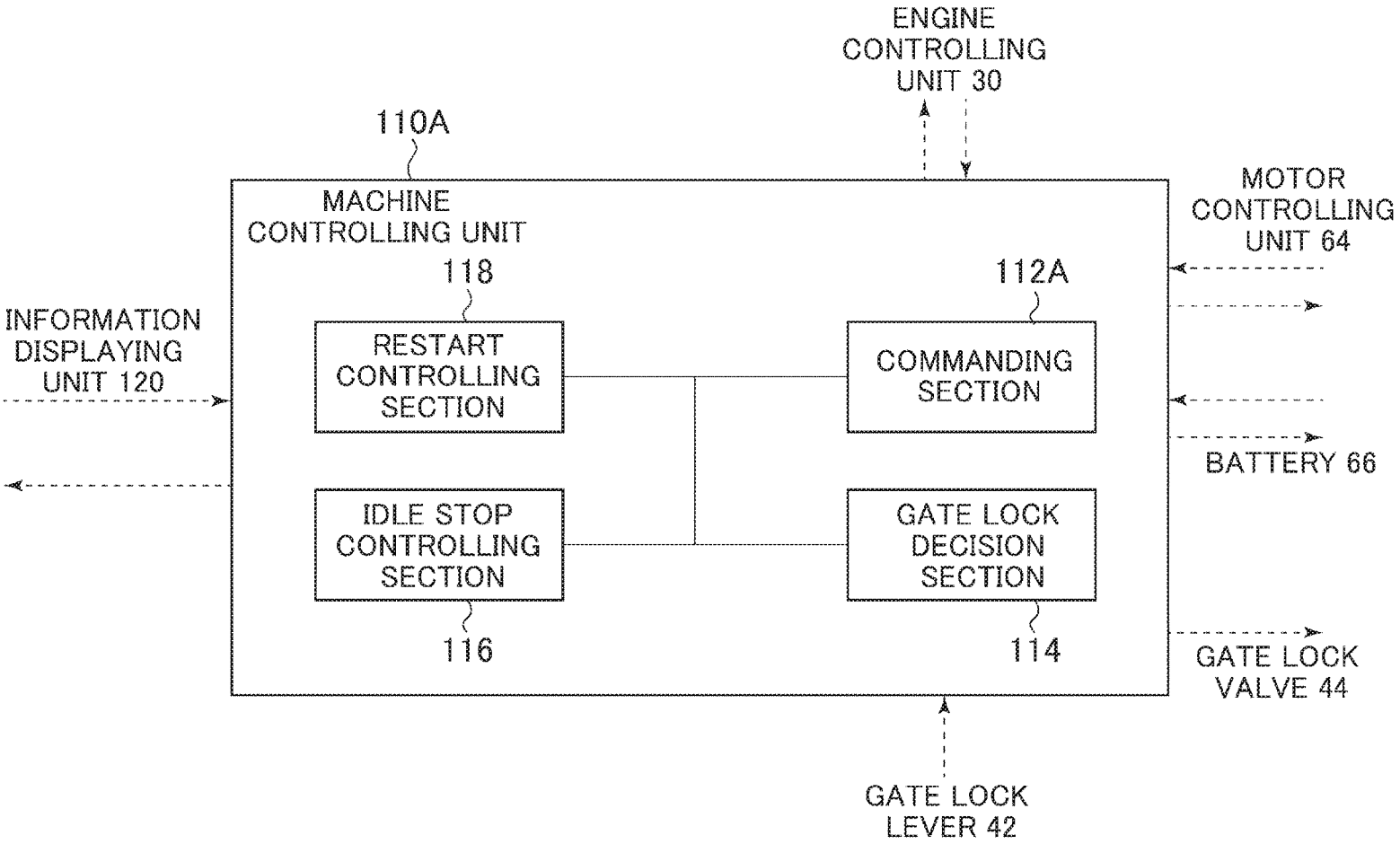
FIG. 9 is a view depicting an example of a functional configuration of a machine controlling unit of a machine controller according to the second embodiment of the present invention.

FIG. 8 is a view depicting an example of a system configuration of the hybrid hydraulic excavator according to the present embodiment. FIG. 9 is a view depicting an example of a functional configuration of a machine controller according to the present embodiment. In FIGS. 8 and 9, like elements to those in the first embodiment are denoted by like reference numerals and description of them is omitted suitably.

As depicted in FIG. 8, the hybrid hydraulic excavator includes, as driving circuits, an assist motor 62 (generator motor), a motor controlling unit 64 and a battery 66 (power storage device) in addition to the configuration described in the first embodiment. Further, the hybrid hydraulic excavator includes, as a control device, a machine controller 100A.

The assist motor 62 is controlled by the motor controlling unit 64 and operates as a motor or a generator. In particular, the assist motor 62 is driven by electric power stored in the battery 66 to assist dynamic power of the engine 32. Further, when the engine 32 has some margin in the power, the assist motor 62 operates as a generator and stores the generated electric power into the battery 66.

The machine controller 100A includes a machine controlling unit 110A and an information displaying unit 120. The machine controlling unit 110A includes a commanding section 112A, a gate lock decision section 114, an idle stop controlling section 116 and a restart controlling section 118 as depicted in FIG. 7.

The commanding section 112A outputs, similarly to the commanding section 112 in the first embodiment, an opening signal or a closing signal to the gate lock valve 44 in response to a signal from the gate lock decision section 114. Further, similarly to the commanding section 112 in the first embodiment, the commanding section 112A outputs a command signal for engine stop to the engine controlling unit 30 in response to a signal from the idle stop controlling section 116. However, different from the commanding section 112 in the first embodiment, the commanding section 112A outputs a command signal for engine restart to the motor controlling unit 64 in response to a signal from the restart controlling section 118. The motor controlling unit 64 controls driving of the assist motor 62 in response to the command signal for restart to restart the engine 32.

Also in the present embodiment, substantially similar effects to those of the first embodiment can be obtained.

<Others>

It is to be noted that the present invention is not limited to the embodiments described above and various modifications and applications are possible. The embodiments described above are described in detail in order to explain the present invention in a straightforward manner, and the present invention is not necessarily limited to those that include all components described hereinabove. As a modification, the inputting device 54 may include a first inputting device by which a first operation for selecting one of a plurality of icons on a screen image displayed on the display device 52 can be performed and a second inputting device that is a separate device from the first inputting device and by which a second operation for inputting a setting or an instruction to determine the selected icon can be performed.

Further, while the embodiments described hereinabove exemplify a hydraulic excavator and a hybrid hydraulic excavator as a work machine, the work machine in the present embodiment is not limited to a hydraulic excavator.

DESCRIPTION OF THE REFERENCE NUMERALS

1: Track structure
2: Swing structure
3: Cabin
4: Front work implement
5: Boom
6: Arm
7: Bucket
8: Boom cylinder
9: Arm cylinder
10: Bucket cylinder
11: Track motor
12: Crawler type track device
13: Operator's seat
14: Left side operation device
15: Right side operation device
16: Switch box
20: Control valve
22: Hydraulic pump
24: Gear pump
30: Engine controlling unit
32: Engine
34: Starter motor
42: Gate lock lever
44: Gate lock valve
51*a*, 51*b*: Switch
52: Display device
53: Rotary switch
54: Inputting device
55: Message
56: Standby icon
57: Restarting icon
58: Confirmation screen image
62: Assist motor (generator motor)
64: Motor controlling unit
66: Battery (power storage device)
100, 100A: Machine controller (control device)
110, 110A: Machine controlling unit
112, 112A: Commanding section
114: Gate lock decision section
116: Idle stop controlling section
118: Restart controlling section
120: Information displaying unit (display controlling unit)
T: Tank

The invention claimed is:

1. A work machine that includes:
an engine;
a hydraulic pump driven by the engine;
a plurality of hydraulic actuators driven by hydraulic fluid from the hydraulic pump;
a lock device having a gate lock lever and configured to control the plurality of hydraulic actuators inoperative in response to an operation position of the gate lock lever; and
a controller configured to stop the engine in response to the operation position of the gate lock lever, the work machine comprising:
a monitor configured to display a confirmation screen image for allowing an operator to confirm whether or not the engine is to be restarted from an idle stop state in which the engine is stopped by the controller; and
an inputting device configured to allow the operator to input a restart instruction for the engine in an interlocked relationship with a display of the confirmation screen image, wherein
the controller is configured to restart the engine based on the restart instruction for the engine inputted through the inputting device.

2. The work machine according to claim 1, wherein
the confirmation screen image has a standby icon and a restarting icon, and
the inputting device allows selection of one of the standby icon and the restarting icon in response to an operation thereof and inputs a restart instruction for the engine by selecting and determining the restarting icon.

3. The work machine according to claim 2, wherein
the monitor displays a state in which the standby icon is selected as an initial state of the confirmation screen image.

4. The work machine according to claim 3, wherein
the inputting device is configured to perform a first operation for selecting one of the standby icon and the restarting icon and a second operation for determining the one selected from the standby icon and the restarting icon, the second operation having an operation mode different from that of the first operation.

5. The work machine according to claim 4, wherein
the inputting device includes a rotary switch for which a rotational operation as the first operation and a pushing operation as the second operation can be performed.

6. The work machine according to claim 1, further comprising:
a generator motor configured to perform generation by dynamic power of the engine and power assistance for the engine by electric drive; and
a battery configured to exchange electric power with the generator motor, wherein
the controller performs driving control of the generator motor to restart the engine.

* * * * *